US008141838B2

(12) United States Patent
Johnson et al.

(10) Patent No.: US 8,141,838 B2
(45) Date of Patent: Mar. 27, 2012

(54) ADJUSTABLE PICTURE HANGER

(75) Inventors: Natalia Johnson, Statesville, NC (US); Christian Scott Leyden, Cornelius, NC (US); Jackie Grant, Charlotte, NC (US)

(73) Assignee: Newell Operating Company, Huntersville, NC (US)

( * ) Notice: Subject to any disclaimer, the term of this patent is extended or adjusted under 35 U.S.C. 154(b) by 233 days.

(21) Appl. No.: 12/584,305

(22) Filed: Sep. 3, 2009

(65) Prior Publication Data

US 2011/0049325 A1 Mar. 3, 2011

(51) Int. Cl.
*A47G 1/24* (2006.01)

(52) U.S. Cl. ..... 248/496; 248/477

(58) Field of Classification Search ..... 248/468, 248/477, 478, 496, 292.12, 225.21, 286.1, 248/339, 476

See application file for complete search history.

(56) References Cited

U.S. PATENT DOCUMENTS

| | | | | | |
|---|---|---|---|---|---|
| 797,076 | A | * | 8/1905 | Schultz | 248/496 |
| 1,932,697 | A | * | 10/1933 | Jankovic | 248/478 |
| 3,529,799 | A | * | 9/1970 | Schaefer | 248/496 |
| 3,848,843 | A | * | 11/1974 | Levy | 248/224.51 |
| 4,641,807 | A | | 2/1987 | Phillips | |
| 4,892,284 | A | * | 1/1990 | Kelrick | 248/476 |
| 5,299,773 | A | * | 4/1994 | Bertrand | 248/514 |
| 6,095,479 | A | | 8/2000 | Brindisi | |
| 6,241,210 | B1 | | 6/2001 | Brindisi | |
| 6,572,067 | B1 | * | 6/2003 | Kamenstein et al. | 248/476 |
| 6,663,075 | B2 | | 12/2003 | Zuller | |
| 6,971,617 | B2 | * | 12/2005 | Nguyen | 248/286.1 |
| 7,913,967 | B1 | * | 3/2011 | Aleo | 248/476 |
| 2005/0178942 | A1 | | 8/2005 | Dodig, Jr. | |

* cited by examiner

*Primary Examiner* — Gwendolyn Baxter
(74) *Attorney, Agent, or Firm* — Taft Stettinius & Hollister LLP

(57) ABSTRACT

An adjustable picture hanger for suspending an object from a surface. An exemplary embodiment may include a base mounted to a wall, a central plate selectively rotatable with respect to the base, and/or a hook slidable in a slot in the plate. The position of the hook relative to the wall may be adjusted by rotating the plate with respect to the base and/or by sliding the hook along the slot.

5 Claims, 5 Drawing Sheets

ADJUSTABLE PICTURE HANGER

BACKGROUND

The present disclosure is directed to wall-mounted picture hangers and, more particularly, to adjustable wall-mounted picture hangers.

SUMMARY

An exemplary adjustable picture hanger may include a base mounted to a wall, a central plate selectively rotatable with respect to the base, and/or a hook slidable in a slot in the plate. The position of the hook relative to the wall may be adjusted by rotating the plate with respect to the base and/or by sliding the hook along the slot.

In an aspect, an adjustable picture hanger may include a base for attaching to a surface; a plate selectively rotatable with respect to the base, the plate including a slot; and a hook for suspending an object, the hook being slidably mounted to the slot.

In a detailed embodiment, the base may include a substantially circular opening, and the plate may be substantially circular and may substantially occupy the opening. In a detailed embodiment, the slot may be arranged generally radially with respect to the plate.

In a detailed embodiment, the base may include a first plurality of teeth, the plate may include a second plurality of teeth, and the first plurality of teeth and the second plurality of teeth may be selectively engagable to inhibit rotation of the plate with respect to the base. In a detailed embodiment, the base and the plate may be spring-biased to engage the first plurality of teeth and the second plurality of teeth. In a detailed embodiment, the first plurality of teeth may be arranged generally circumferentially around a substantially circular opening in the base, the plate may be substantially circular and may substantially occupy the opening, and the second plurality of teeth may be arranged generally circumferentially around the plate to selectively engage the first plurality of teeth.

In a detailed embodiment, the hook may include a knob. In a detailed embodiment, the knob may include a post extending through the slot and threadedly engaging a retainer. In a detailed embodiment, the base may include at least one extension including a hole for receiving a fastener.

In an aspect, an adjustable picture hanger may include a base having a generally circular opening; a generally circular plate rotatably disposed within the opening, the plate including a slot, the slot being generally radially oriented; and a hook extending from the plate and slidably engaged with the slot.

In a detailed embodiment, the hook may include a knob. In a detailed embodiment, the opening may include a first plurality of teeth arranged to selectively engage a second plurality of teeth on the plate, and engagement of the first plurality of teeth with the second plurality of teeth may prevent rotation of the plate with respect to the base. In a detailed embodiment, the first plurality of teeth may be arranged substantially circumferentially about the opening, and the second plurality of teeth may be arranged substantially circumferentially about the plate. In a detailed embodiment, an adjustable picture hanger may include at least one spring biasing the plate to engage the second plurality of teeth with the first plurality of teeth.

In a detailed embodiment, the base may include at least one extension including a hole for receiving a fastener.

In an aspect, a method of mounting an object to a wall may include affixing a picture hanger to a wall using at least one fastener extending through at least one hole in the picture hanger, the picture hanger including a base, a plate selectively rotatable with respect to the base, and a hook slidable along a slot in the plate; moving the hook with respect to the wall by rotating the plate with respect to the base; moving the hook with respect to the wall by sliding the hook along the slot; and suspending an object from the hook.

In a detailed embodiment, rotating the plate with respect to the base may include disengaging a plurality of teeth extending from the plate from a plurality of teeth extending from the base. In a detailed embodiment, rotating the plate may include pressing the plate towards the wall to disengage the plurality of teeth extending from the plate from the plurality of teeth extending from the base. In a detailed embodiment, pressing the plate towards the wall may include overcoming a force exerted by at least one spring arranged to bias the plate away from the wall. In a detailed embodiment, a method may include fixing the hook in position with respect to the slot by tightening the hook and a retainer against opposite sides of the rotating plate.

BRIEF DESCRIPTION OF THE DRAWINGS

The detailed description refers to the following figures in which.

DETAILED DESCRIPTION

The present disclosure contemplates that articles, such as picture frames, may be suspended from hangers mounted to walls. In addition, the present disclosure contemplates that it may be difficult to correctly identify the precise location for the hanger that results in the picture frame hanging in the desired position. Exemplary adjustable picture hangers according to the present disclosure allow positional adjustment with respect to the wall, thereby obviating the need to re-mount a hanger when a minor adjustment in position is necessary.

Figure 1:
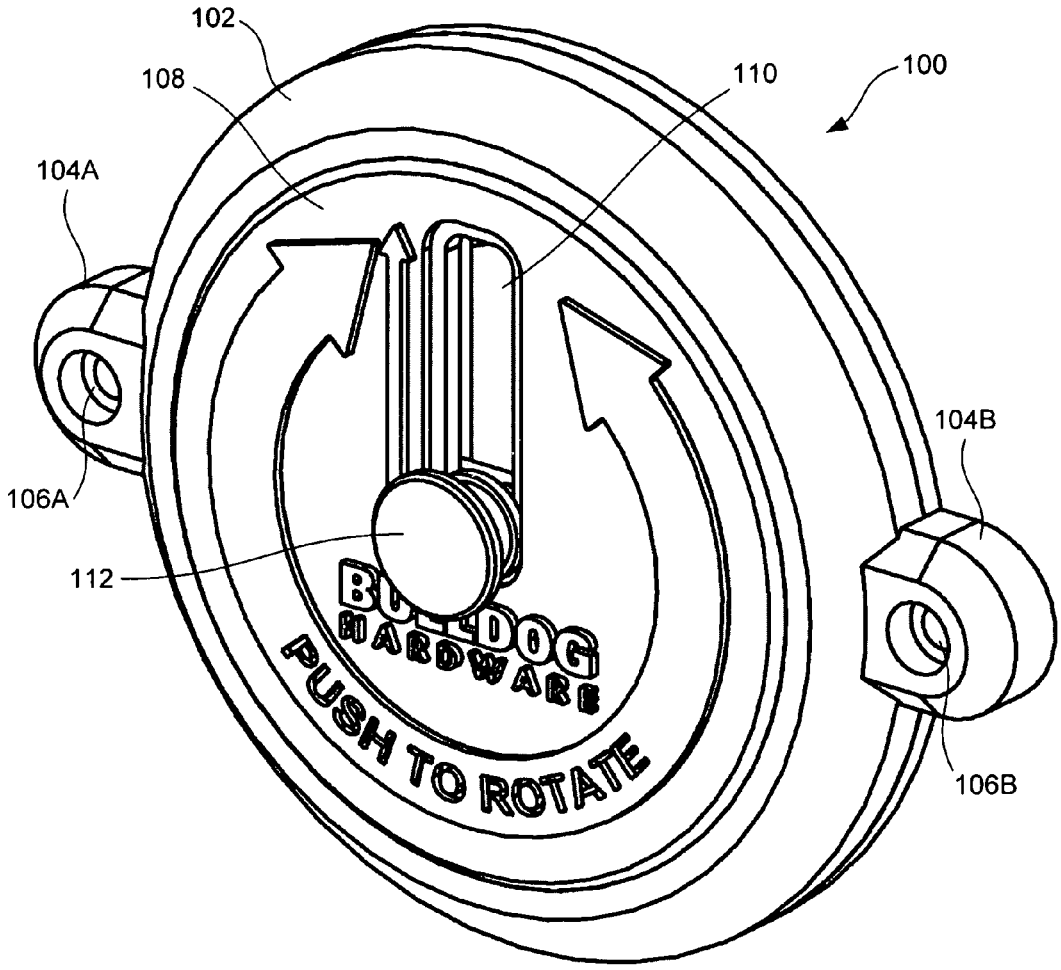
FIG. 1 is a perspective view of an exemplary adjustable picture hanger.
Figure 2:
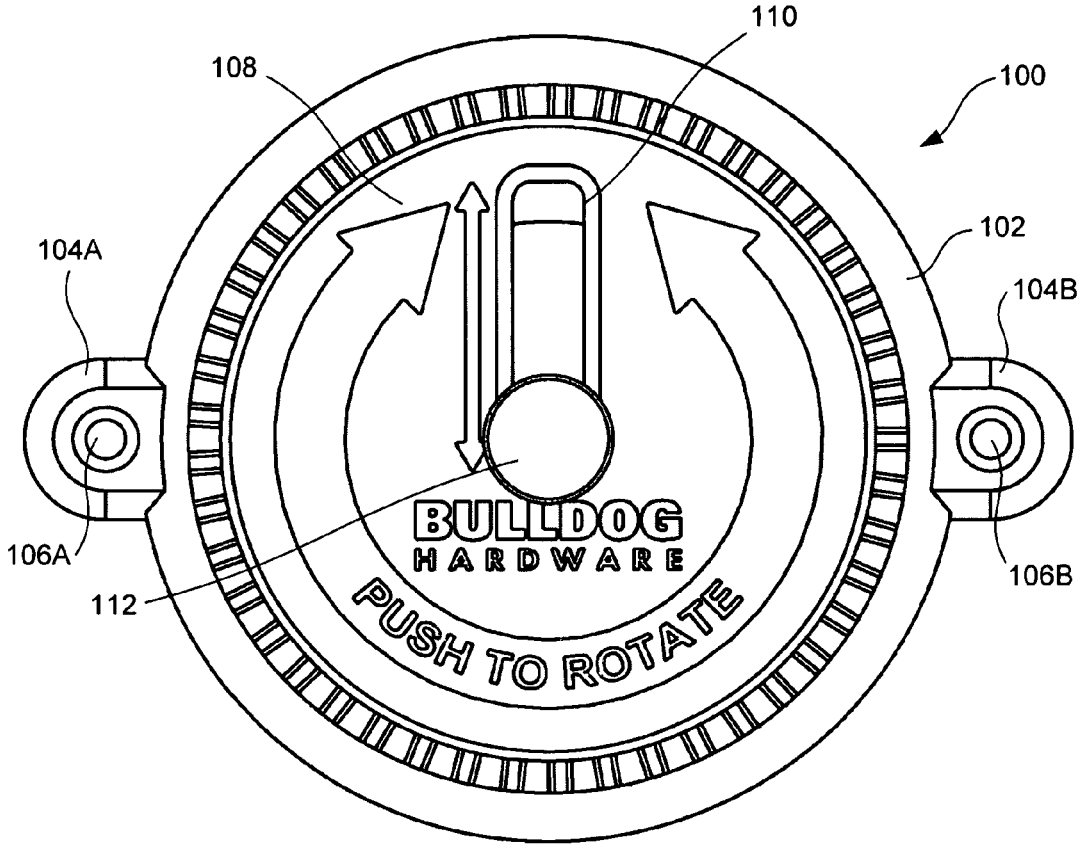
FIG. 2 is a front elevation view of an exemplary adjustable picture hanger.

Referring to FIGS. 1 and 2, an exemplary adjustable picture hanger 100 may include a base 102, a center plate 108, and/or a hook 112. An exemplary base 102 may include one or more holes 106A, 106B for mounting the base 102 to a wall. In some exemplary embodiments, the holes 106A, 106B may be provided in extensions 104A, 104B on a generally circular base 102. It is within the scope of the disclosure to include more or fewer than the two extensions 104A, 104B and/or holes 106A, 106B illustrated in FIG. 1.

In an exemplary embodiment, center plate 108 may be rotatable relative to the base 102. An exemplary center plate 108 may include a slot 110 which may slidably receive the hook 112. Thus, by rotating the center plate 108 and/or translating the hook 112 within the slot 110, the position of the hook 112 relative to the base 102 may be adjusted within the area covered by the center plate 108.

Figure 3:
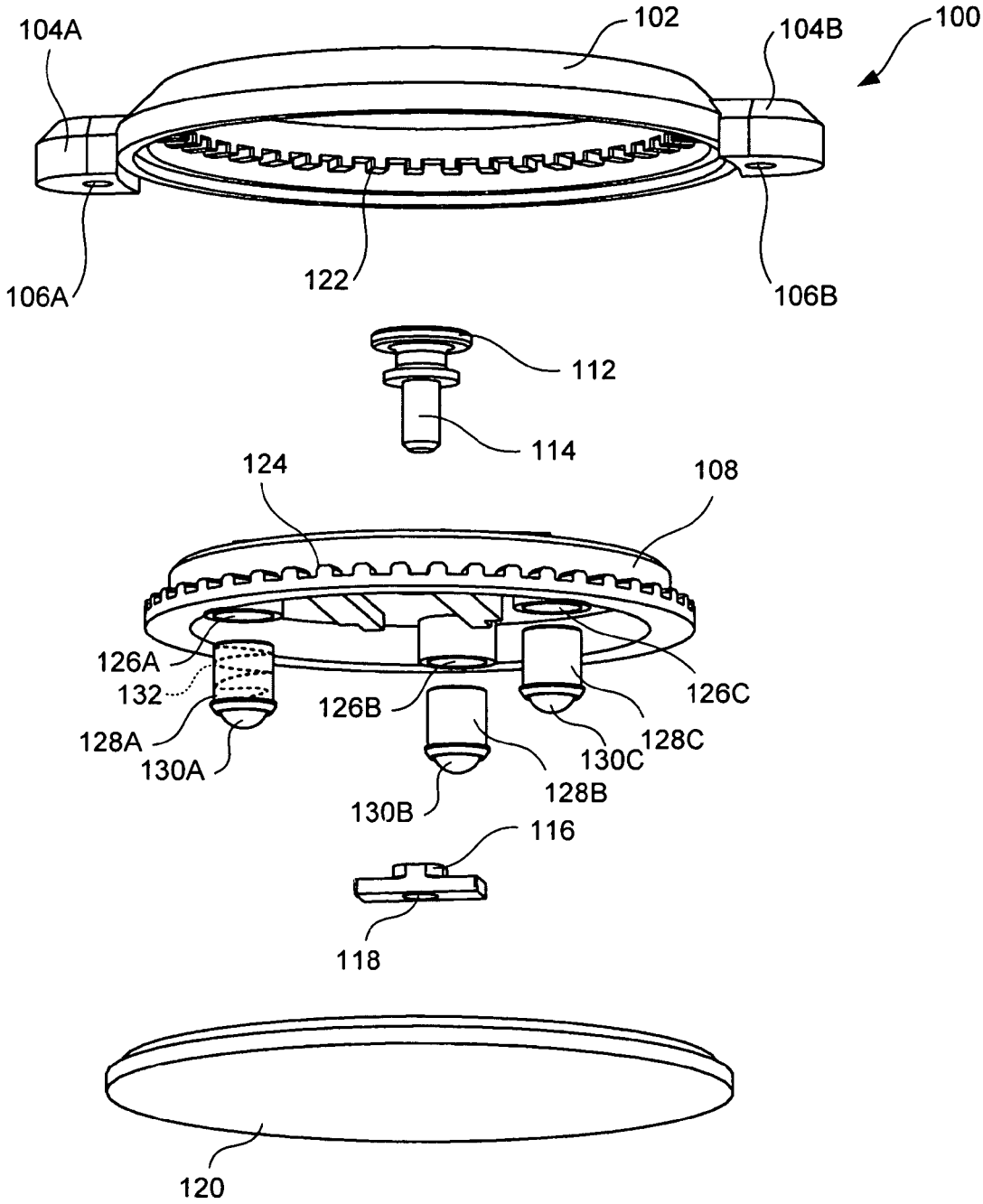
FIG. 3 is an exploded perspective view of an exemplary adjustable picture hanger.
Figure 4:
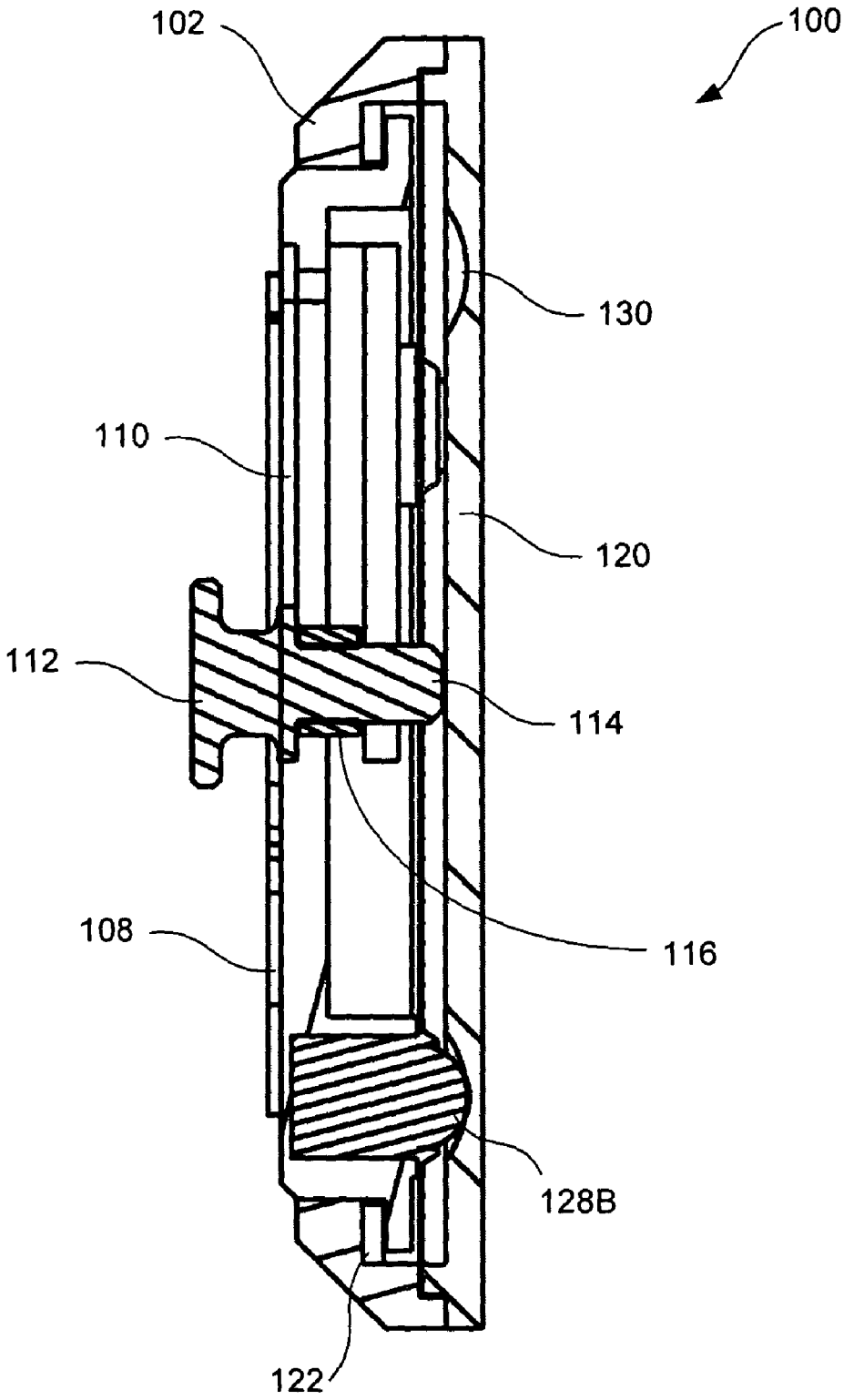
FIG. 4 is a cross-sectional view of an exemplary adjustable picture hanger.

Referring to FIGS. 3 and 4, an exemplary base 102 may include teeth 122 which may selectively engage teeth 124 associated with the center plate 108. The center plate 108 may receive one or more spring plungers 128A, 128B, 128C, in corresponding holes 126A, 126B, 126C. An individual spring plungers 128A may include a ball 130A which may be biased towards an extended position by an internal spring 132. A rear cover 120 may attach to base 102, trapping center plate 108 therebetween. Balls 130A, 130B, 130C of spring plungers 128A, 128B, 128C may press against rear plate 120 (such as in annular groove 130), thereby biasing teeth 124 of center plate 108 into engagement with teeth 122 of base 102. Hook 112 (which may take the form of a knob in some exemplary embodiments) may include a post 114 which may extend through slot 110 in center plate 108 and which may engage hole 118 of retainer 116. A portion of retainer 116 may be wider than slot 110 such that hook 112 is slidably retained on center plate 108.

In some exemplary embodiments, post 114 and hole 118 may include corresponding threads. This may permit the position of hook 112 to be temporarily fixed within the slot by turning the knob, thereby pinching the center plate 108 proximate the slot 110 between the hook 112 and the retainer 116. In some exemplary embodiments, the retainer 116 may include one or more teeth, which may engage an inner surface of the center plate 108 proximate the slot 110.

Figure 5:
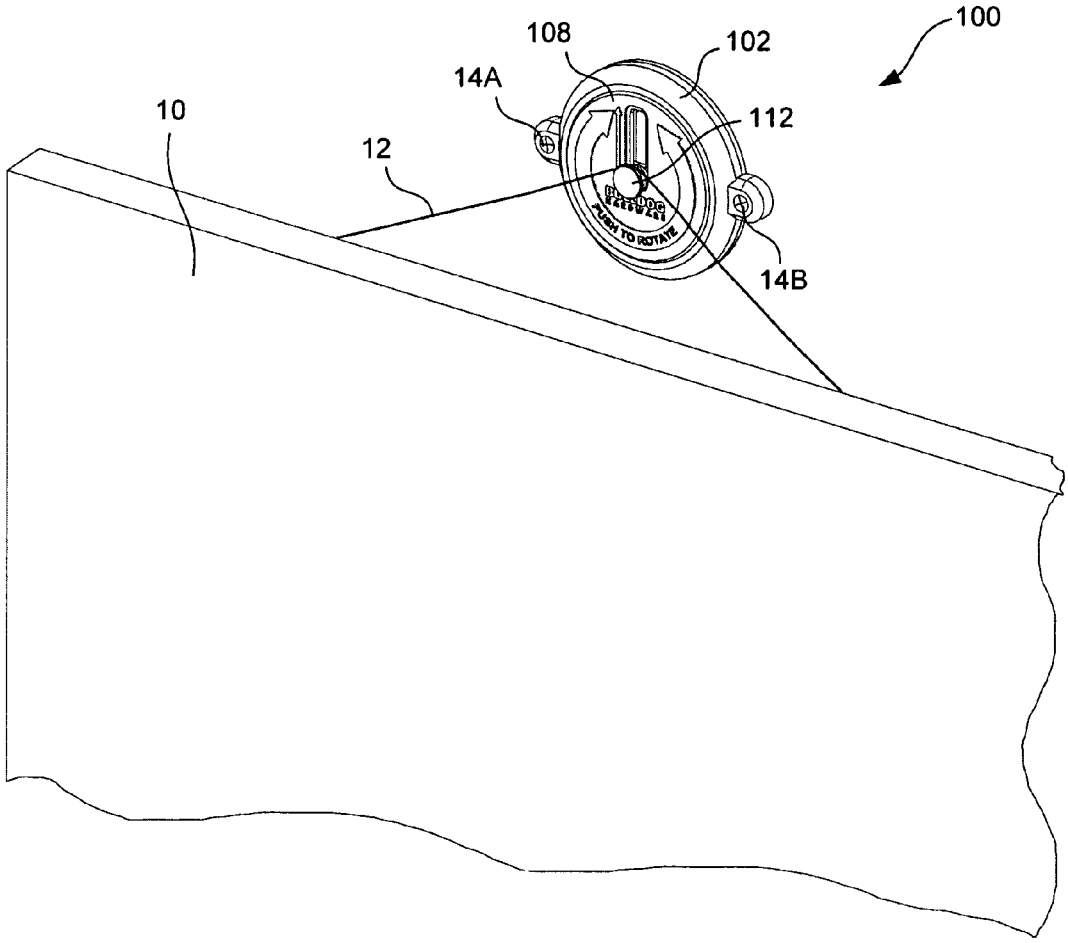
FIG. 5 is a perspective view of an object suspended from an exemplary adjustable picture hanger; all in accordance with at least some aspects of the present disclosure.

FIG. 5 illustrates an object 10 suspended from an exemplary adjustable picture hanger 100. Fasteners 14A, 14B (such as screws and/or nails) may affix the base 102 to a wall. Picture wire 12 associated with object 10 may at least partially engage hook 112.

An exemplary adjustable picture hanger 100 may be used as follows. The base 102 may be mounted to a wall using fasteners 14A, 14B extending through holes 106A, 106B in extensions 104A, 104B. The position of the hook 112 relative to the base 102 (and relative to the wall) may be adjusted by rotating the center plate 108 and/or by sliding the hook 112 in the slot 110. The center plate 108 may be rotated by pressing the center plate 108 towards the rear cover 120 (e.g., towards the wall), thereby disengaging teeth 112 from teeth 124. While keeping the center plate 108 depressed, the center plate 108 may be rotated. Once the center plate 108 is in the desired angular orientation, it may be released, which may allow the spring plungers 128A, 128B, 128C to move the center plate 108 away from the rear cover 120, thereby engaging teeth 122 with teeth 124.

As used herein, the term "picture hanger" refers to a hanger used to suspend an object from a surface, such as a generally vertical wall. It is not necessary that the object be a picture, and any object may be suspended from exemplary adjustable picture hangers disclosed herein. For example, various framed objects (such as photographs, paintings, certificates, diplomas, posters, etc.) and non-framed objects (such as tapestries, wall hangings, etc.) may be suspended from exemplary adjustable picture hangers. In addition, suspended objects may include picture wire, cord, sawtooth hangers, eye hooks, or any other attachment devices for suspending the objects from exemplary adjustable picture hangers.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages may exist even though they may not have been explicitly discussed herein.

What is claimed is:

1. A method of mounting an object to a wall, the method comprising:

affixing a picture hanger to a wall using at least one fastener extending through at least one hole in the picture hanger, the picture hanger including a base, a plate selectively rotatable with respect to the base, and a hook slidable along a slot in the plate;

moving the hook with respect to the wall by rotating the plate with respect to the base;

moving the hook with respect to the wall by sliding the hook along the slot; and suspending an object from the hook.

2. The method of claim 1, wherein rotating the plate with respect to the base includes disengaging a plurality of teeth extending from the plate from a plurality of teeth extending from the base.

3. The method of claim 2, wherein rotating the plate includes pressing the plate, towards the wall to disengage the plurality of teeth extending from the plate from the plurality of teeth extending from the base.

4. The method of claim 3, wherein pressing the plate towards the wall includes overcoming a force exerted by at least one spring arranged to bias the plate away from the wall.

5. The method of claim 1, further comprising fixing the hook in position with respect to the slot by tightening the hook and a retainer against opposite sides of the rotating plate.

* * * * *